United States Patent [19]

El-Amin

[11] 4,317,245

[45] Mar. 2, 1982

[54] WATER BED SHEET

[76] Inventor: Nu'man W. El-Amin, 4858 Logan Ave., Apt. 1, San Diego, Calif. 92113

[21] Appl. No.: 106,769

[22] Filed: Jan. 21, 1980

[51] Int. Cl.[3] ..... A47G 9/00

[52] U.S. Cl. ..... 5/497; 5/496

[58] Field of Search ..... 5/497, 496, 495, 482, 5/485, 498, 488

[56] References Cited

U.S. PATENT DOCUMENTS 1,825,520 9/1931 Grunfeld ..... 5/485

4,062,076 12/1977 Albertson ..... 5/482

*Primary Examiner*—Alexander Grosz

*Attorney, Agent, or Firm*—Ralph S. Branscomb

[57] ABSTRACT

A contoured sheet is providing having slits adjacent to corners thereof to permit the person making up the bed to reach through the slit to elevate the respective corner of the bed subsequent to which he can more easily pull the contoured corner over the corner of the sheet.

3 Claims, 9 Drawing Figures

WATER BED SHEET

BACKGROUND OF THE INVENTION

Anyone who is a regular bed maker will acknowledge the great benefit of contour sheets. However, one disadvantage of contour sheets is that some corners of the mattress are difficult to engage by the corners of the sheet. This is particularly true the closer one gets to the last corner of the mattress, and if one started at the wrong corner and finishes at a hard to get position, it can require a herculean effort to elevate the mattress corner in order to pull the sheet over it.

This problem is particularly aggravated with waterbeds because not only is the corner heavy and awkward but one cannot get one's hand beneath the waterbed because of the typical waterbed frame, making it extremely difficult, especially to accommodate the last corner, at which the sheet is ordinarily rather tight.

SUMMARY OF THE INVENTION

The present invention simplifies enormously the task of making a bed with a contour sheet, and is of particular significance when related to waterbeds which are now so popular, especially in the west. By the provision of a variety of different embodiments of openings at one or more of the corners of the sheet, the user can reach through the opening and simultaneously raise the mattress corner by means of the hand reached through the opening and lower the sheet by means of the other hand. There is also the further problem, peculiar to water beds, that as one lifts the corner of the water mattress clear of the frame, the water runs out and the corner literally dissappears, leaving nothing around which to fit the sheet. This is truely a maddening problem.

DETAILED DESCRIPTION OF THE PREFERRED EMBODIMENTS

The main body of a contoured sheet which comprises the environment of the present invention, as well as part of the same, is shown at 10. This illustrates a contour sheet as it would appear in its expanded form, such as engaged over a mattress and having the openings of the present invention at 12 adjacent to corners. The openings 12 are in the generally planar, flat top portion of the sheet.

Figure 1:
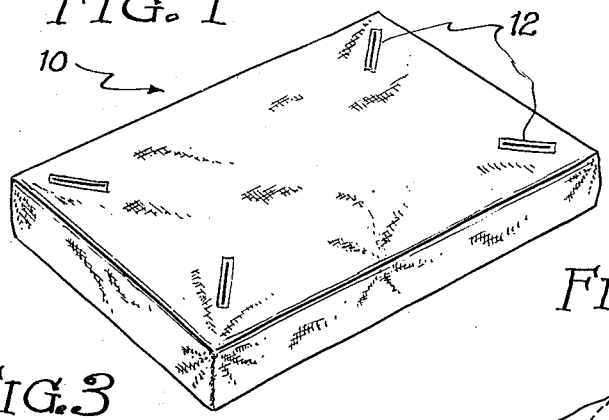
FIG. 1 is a perspective view of the principal embodiment of the invention.
Figure 2:
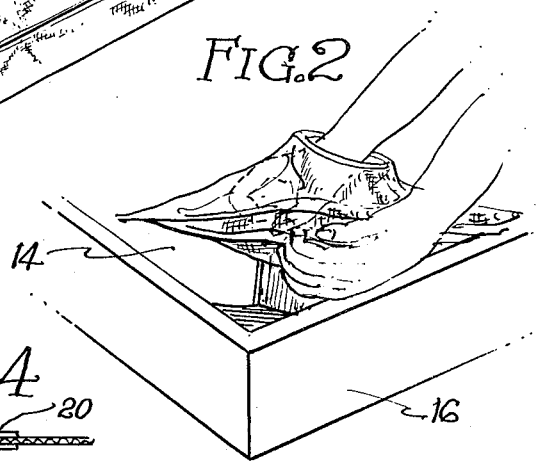
FIG. 2 is a perspective view of the sheet of FIG. 1 in use.

FIG. 2 illustrates a waterbed mattress 14 having a frame 16 and illustrates the fashion in which a person reaches through the opening 12, or one of them, to pull up the edge of the waterbed mattress to permit pulling down of the corner of the sheet. Although in the embodiments shown in FIGS. 1 and 9 there are four slits corresponding to the corners of the sheet, there could be one, two or three slits only, in anticipation that the user would not have as difficult a time with the first, second or third corner, the difficulty increasing with each corner until the last one is reached.

Figure 3:
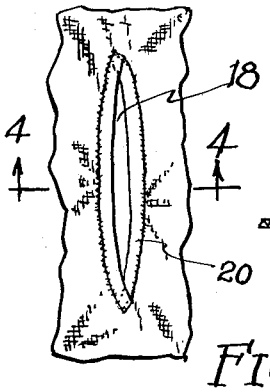
FIG. 3 is a front elevation view of a slit detail.
Figure 4:
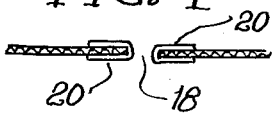
FIG. 4 is a section taken along line 4—4 of FIG. 3.
Figure 5:
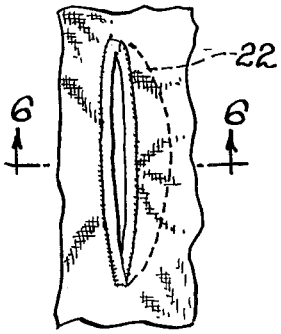
FIG. 5 is an elevation view of a modified form of slit having a flap therebehind.
Figure 6:
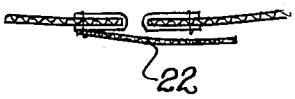
FIG. 6 is a sectional view taken along line 6—6 of FIG. 5.

Turning to the details showing the slit itself, in the embodiment of FIG. 3 a simple slit 18 hemmed at 20 would represent the simplest implementation. FIGS. 5 and 6 show a hemmed slit similar to that of FIGS. 3 and 4 with the addition of a flap 22 stitched behind the slit to cover same when the sheet is stretched taut. The flap could of course be made to lie over, as well as under, the slit.

Figure 7:
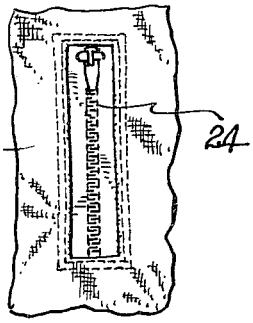
FIG. 7 is a front elevational view of a zippered slit embodiment.
Figure 8:
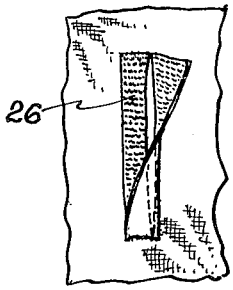
FIG. 8 is a front elevation view of a hook and loop type fastener, such as the one sold under the trademark "Velcro" slit embodiment.
Figure 9:
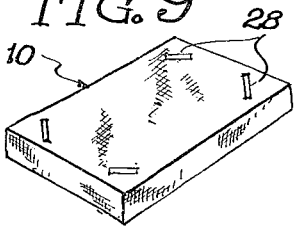
FIG. 9 is a perspective view of a mattress with a modified slit orientation.

FIGS. 7 and 8 both disclose means of closing the slit, the first being a zipper 24 in FIG. 7 and the second being mating strips of hook and loop type fastener, such as the one sold under the trademark "Velcro" 26. Lastly, FIG. 9 illustrates slots 28 oriented across the corner rather than in alignment with them.

Regardless of the embodiment used, the sheet of the present invention and the method of utilizing same represents an advance in the art of sheet making which will become quite apparent to the housewife charged with the daily making of a bed, and particularly a waterbed.

The scope of the claims appended hereto shall be given the full breadth indicated by the language contained therein and shall not be limited to the particular embodiments shown or other limitations set forth in the specification.

I claim:

1. A contour bedsheet comprising:

(a) a generally rectangular sheet having a planar top portion and four corners contoured to wrap around the corners of a mattress;

(b) four slitlike openings provided in said planar top portion adjacent each respective corner of said sheet to permit one to reach through said openings to engage and raise the respective corner of a mattress to slip said bedsheet thereover.

2. A method of making a mattress with a contoured bedsheet having an opening adjacent at least one corner thereof comprising the following steps:

(a) engaging all corners of said sheet not having an opening adjacent thereto over the respective corners of a mattress;

(b) reaching through said at least one opening and said bedsheet with one hand;

(c) engaging the respective corner of the mattress beneath said at least one opening with said one hand;

(d) pulling the respective corner upwardly with one hand;

(e) pulling the respective corner of said sheet over the respective corner of the mattress with the other hand;

(f) releasing said hands permitting said mattress and sheet to fall into place; and (g) repeating steps (b) through (f) at all corners of said bedsheet having a hole adjacent thereto not previously tucked in.

3. The method according to claim 2 wherein said at least one opening includes means to close same, and including the step after step (f) of closing same.

* * * * *